US009419414B2

(12) United States Patent
Kato

(10) Patent No.: US 9,419,414 B2
(45) Date of Patent: Aug. 16, 2016

(54) SPARK PLUG

(75) Inventor: Tomoaki Kato, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 271 days.

(21) Appl. No.: 14/124,489

(22) PCT Filed: Mar. 7, 2012

(86) PCT No.: PCT/JP2012/001561

§ 371 (c)(1),
(2), (4) Date: Dec. 6, 2013

(87) PCT Pub. No.: WO2012/172712

PCT Pub. Date: Dec. 20, 2012

(65) Prior Publication Data

US 2014/0111079 A1 Apr. 24, 2014

(30) Foreign Application Priority Data

Jun. 17, 2011 (JP) ..... 2011-134752

(51) Int. Cl.

| | |
|---|---|
| ***H01T 13/39*** | (2006.01) |
| ***F02P 13/00*** | (2006.01) |
| ***H01T 13/16*** | (2006.01) |
| ***H01T 13/20*** | (2006.01) |

(52) U.S. Cl.

CPC ..... *H01T 13/39* (2013.01); *F02P 13/00* (2013.01); *H01T 13/16* (2013.01); *H01T 13/20* (2013.01)

(58) Field of Classification Search

CPC ..... F02P 13/00; H01T 13/16; H01T 13/20; H01T 13/39

See application file for complete search history.

(56) References Cited

U.S. PATENT DOCUMENTS

2008/0122334 A1 5/2008 Kishimoto et al.
2010/0275870 A1* 11/2010 Kameda ..... H01T 13/32 123/169 EL

FOREIGN PATENT DOCUMENTS

| | | | |
|---|---|---|---|
| JP | 60-142487 | U | 9/1985 |
| JP | 4-206376 | A | 7/1992 |
| JP | 7-37678 | A | 2/1995 |
| JP | 2008130463 | A | 6/2008 |

OTHER PUBLICATIONS

JPO/ISA, International Search Report issued in the international stage of subject application, PCT/JP2012/001561, mailed Jun. 12, 2012.

* cited by examiner

*Primary Examiner* — Nimeshkumar Patel
*Assistant Examiner* — Jacob R Stern
(74) *Attorney, Agent, or Firm* — Stites & Harbison, PLLC; Jeffrey A. Haeberlin; James R. Hayne

(57) ABSTRACT

In a spark plug, at least one of a center electrode and a ground electrode has a cover portion and a core portion having a different thermal expansion coefficient. The core portion has a concave portion and a convex portion formed at a front end thereof. The convex portion is such that, in a cross section passing through a barycenter of a front surface of the electrode and also passing through the convex portion, an area of the convex portion delimited by a line perpendicular to a bisector of the convex portion and passing through a point 0.2 mm shifted from a front end of the convex portion in the direction of the bisector is smaller than an area of a triangle formed by connecting the front end of the convex portion and intersections of the line perpendicular to the bisector and a contour of the convex portion.

11 Claims, 14 Drawing Sheets

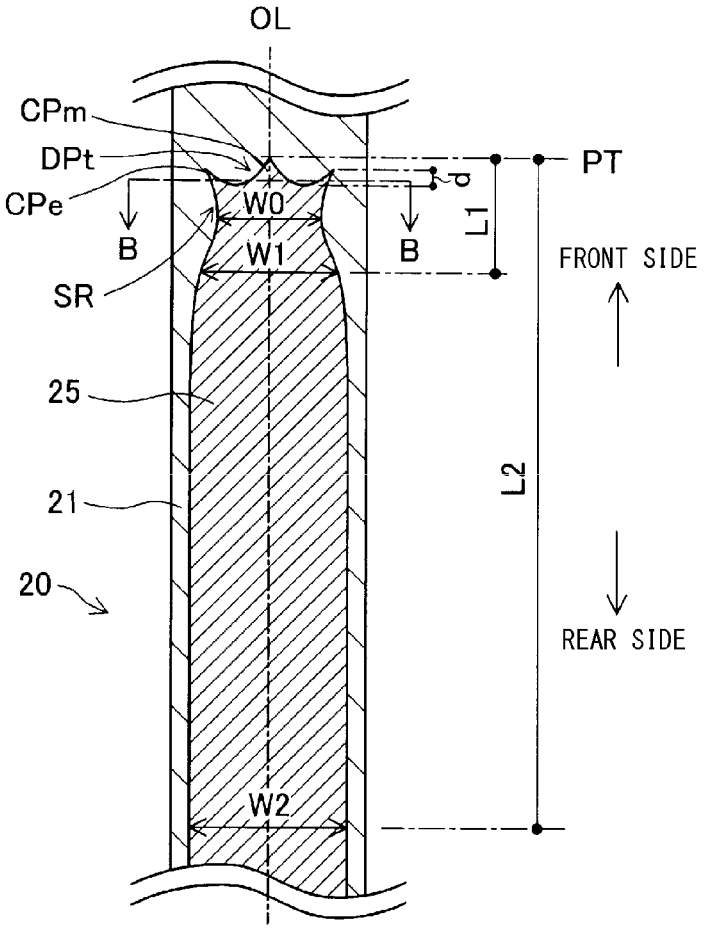
W1/W2≧0.6
(b)
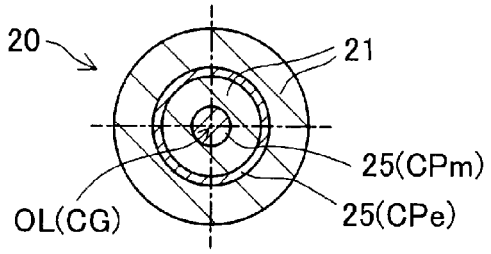
FIG. 4

W1/W2≧0.6

| SAMPLE No. | CROSS-SECTIONAL AREA OF ELECTRODE ($mm^2$) | FRONT SHAPE OF CORE PORTION | JUDGMENT |
|---|---|---|---|
| 1 | 4.2 | ① | ○ |
| 2 | 4.2 | ② | ○ |
| 3 | 4.2 | ③ | ○ |
| 4 | 3.8 | ① | ○ |
| 5 | 3.8 | ② | ○ |
| 6 | 3.8 | ③ | ○ |
| 7 | 3.8 | ④ | ○ |
| 8 | 3.5 | ① | × |
| 9 | 3.5 | ② | ○ |
| 10 | 3.5 | ③ | ○ |
| 11 | 3.5 | ④ | ○ |
| 12 | 3.1 | ① | × |
| 13 | 3.1 | ② | ○ |
| 14 | 3.1 | ③ | ○ |

* TEMPERATURE SETTING: TEMPERATURE OF FRONT END OF CENTER ELECTRODE (SAMPLE No. 8) REACHES 800°C
* HEATING FOR 2 MINUTES ⇔ COOLING FOR 1 MINUTE, 1,000 CYCLES
* JUDGMENT ○: NO FRONT GAP △: SMALL FRONT GAP ×: LARGE FRONT GAP

| SAMPLE No. | CROSS-SECTIONAL AREA OF ELECTRODE ($mm^2$) | FRONT SHAPE OF CORE PORTION | DIAMETER RATIO W1/W2 | FORMATION OF SMALL CONVEX PORTION | JUDGMENT | | |
|---|---|---|---|---|---|---|---|
| | | | | | 1000 CYCLES | 1500 CYCLES | 2000 CYCLES |
| 15 | 3.5 | ① | 0.5 | NO | × | × | × |
| 16 | 3.5 | ① | 0.6 | NO | × | × | × |
| 17 | 3.5 | ② | 0.5 | NO | × | × | × |
| 18 | 3.5 | ② | 0.6 | NO | △ | × | × |
| 19 | 3.5 | ③ | 0.6 | NO | △ | × | × |
| 20 | 3.5 | ④ | 0.5 | YES | ○ | △ | △ |
| 21 | 3.5 | ④ | 0.6 | YES | ○ | ○ | △ |
| 22 | 3.5 | ⑤ | 0.5 | NO | ○ | △ | △ |
| 23 | 3.5 | ⑤ | 0.7 | NO | ○ | ○ | △ |
| 24 | 3.5 | ⑥ | 0.9 | YES | ○ | ○ | ○ |

* TEMPERATURE SETTING: TEMPERATURE OF FRONT END OF CENTER ELECTRODE (SAMPLE No. 15) REACHES 850°C
* HEATING FOR 2 MINUTES ⇔ COOLING FOR 1 MINUTE, 1,000 TO 2,000 CYCLES
* JUDGMENT ○: NO FRONT GAP △: SMALL FRONT GAP ×: LARGE FRONT GAP

FRONT SHAPE OF CORE PORTION

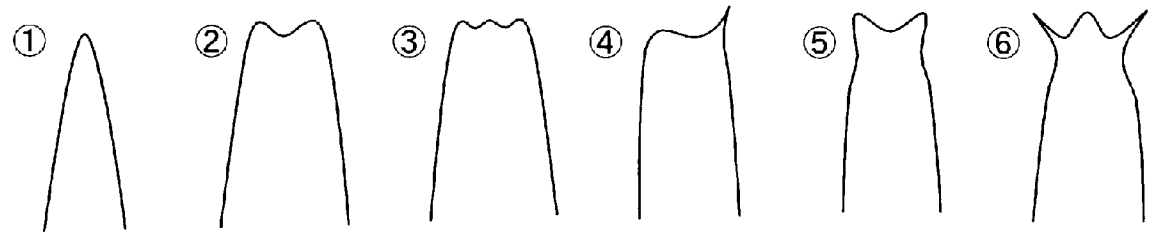

FIG. 13

(a)
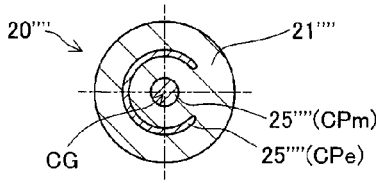
(b)
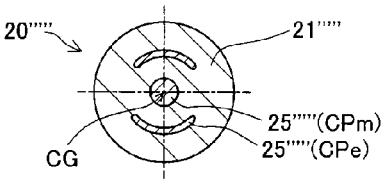
FIG. 16
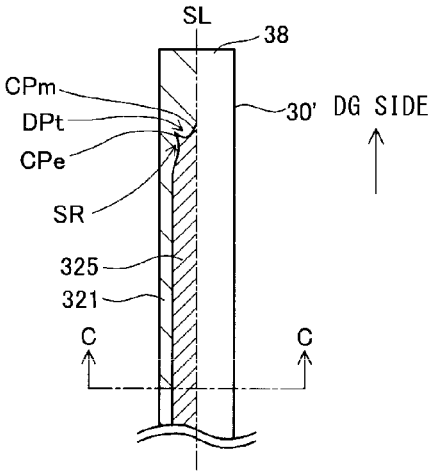
FIG. 17
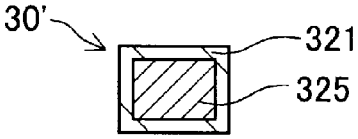
FIG. 18

SPARK PLUG

TECHNICAL FIELD

The present invention relates to a spark plug including a center electrode and a ground electrode and particularly to a spark plug having a structure in which at least one of the center electrode and the ground electrode includes a cover portion and a core portion.

BACKGROUND ART

A spark plug used for ignition of an internal combustion engine such as a gasoline engine generally includes a center electrode, an insulator provided externally of the center electrode, a metallic shell provided externally of the insulator, and a ground electrode attached to the metallic shell with a gap (discharge gap) formed between the ground electrode and the center electrode to allow spark discharge to occur therebetween (the ground electrode is also referred to as an "outer electrode"). In the following description, the side toward the gap is referred to as the "front side" of the center electrode or the ground electrode, and the side opposite to the "front side" is referred to as the "rear side."

In known spark plugs, at least one of the center electrode and the ground electrode (hereinafter may be collectively referred to simply as "electrodes") includes a cover portion formed of a prescribed material (e.g., nickel or a nickel alloy) and a core portion formed of a material (e.g., copper) having a thermal expansion coefficient different from that of the cover portion and covered with the cover portion (see, for example, Patent Documents 1 and 2). In such a spark plug, when a material having high thermal conductivity is selected as the material of the core portion, the heat transfer performance of the electrode can be improved.

PRIOR ART DOCUMENT

Patent Document

Patent Document 1: Japanese Patent Application Laid-Open (kokai) No. H04-206376

Patent Document 2: Japanese Patent Application Laid-Open (kokai) No. 2008-130463

SUMMARY OF THE INVENTION

Problem to be Solved by the Invention

When an electrode of a spark plug is configured to include a cover portion and a core portion, the difference in thermal expansion coefficient between the cover portion and the core portion may cause a gap to occur near the boundary between the cover portion and the core portion on the front side of the electrode during use under exposure to thermal cycles (this gap is hereinafter referred to as a "front gap"). When such a front gap occurs in the electrode, heat transfer from the cover portion to the core portion is hindered, so that the heat transfer performance of the electrode deteriorates. In this case, problems such as occurrence of voids (pores) in the core portion and breakage of the electrode or other members due to expansion of the electrode may occur. In recent years, spark plugs are being reduced in diameter. Therefore, there is a growing demand to reduce the diameters of electrodes, and one important task is to suppress the occurrence of a front gap.

The present invention has been made to solve the foregoing problems. An object of the invention is, in a spark plug having a structure in which at least one of a center electrode and a ground electrode includes a cover portion and a core portion formed of a material having a thermal expansion coefficient different from that of the cover portion, to suppress occurrence of a gap between the cover portion and the core portion during use of the spark plug.

Means for Solving the Problem

To solve, at least partially, the above problem, the present invention can be embodied in the following modes or application examples.

Application Example 1

A spark plug comprising a center electrode and a ground electrode which forms a gap between the ground electrode and the center electrode, wherein, when a side toward the gap is taken as a front side of the center electrode or the ground electrode, at least one of the center electrode and the ground electrode has a cover portion and a core portion covered with the cover portion and formed of a material having a thermal expansion coefficient different from a thermal expansion coefficient of the cover portion, the core portion of the at least one electrode has a concave portion and a convex portion formed at a front end thereof, and the convex portion is such that, in a cross section passing through a barycenter of a front surface of the electrode and also passing through the convex portion, an area of the convex portion delimited by a line perpendicular to a bisector of the convex portion and passing through a point 0.2 mm shifted from a front end of the convex portion in a direction of the bisector is smaller than an area of a triangle formed by connecting the front end of the convex portion and intersections of the line perpendicular to the bisector and a contour of the convex portion.

Application Example 2

The spark plug described in the application example 1, wherein a ratio of a diameter of the core portion at a position 1 mm shifted from a position of a front end of the core portion in a direction perpendicular to a radial direction to a diameter of the core portion at a position 5 mm shifted from the position of the front end of the core portion in the direction perpendicular to the radial direction is 0.6 or larger.

Application Example 3

The spark plug described in the application example 1 or 2, wherein a radial cross section of the electrode at a front end of the core portion has an area of 3.5 $mm^2$ or smaller.

Application Example 4

The spark plug described in any of the application examples 1 to 3, wherein the core portion has a diameter reduction portion formed such that a diameter thereof decreases toward a rear end of the core portion.

Application Example 5

The spark plug described in any of the application examples 1 to 4, wherein at least one of the center electrode and the ground electrode has, as a radial cross section, a cross section in which the core portion, the cover portion, the core portion, the cover portion, and the core portion are arranged in this order on at least one straight line passing through a center of the cross section.

Application Example 6

The spark plug described in the application example 5, wherein at least one of the center electrode and the ground electrode has, as a radial cross section, a cross section in which the core portion, the cover portion, the core portion, the cover portion, and the core portion are arranged in this order on any straight line passing through the center of the cross section.

Application Example 7

A spark plug comprising a center electrode and a ground electrode which forms a gap between the ground electrode and the center electrode, wherein, when a side toward the gap is taken as a front side of the center electrode or the ground electrode, at least one of the center electrode and the ground electrode has a cover portion and a core portion covered with the cover portion and formed of a material having a thermal expansion coefficient different from a thermal expansion coefficient of the cover portion, the core portion of the at least one electrode has a concave portion formed at a front end thereof, and the core portion has a diameter reduction portion formed such that a diameter thereof decreases toward a rear end of the core portion.

Application Example 8

The spark plug described in the application example 7, wherein a ratio of a diameter of the core portion at a position 1 mm shifted from a position of a front end of the core portion in a direction perpendicular to a radial direction to a diameter of the core portion at a position 5 mm shifted from the position of the front end of the core portion in the direction perpendicular to the radial direction is 0.6 or larger.

Application Example 9

The spark plug described in the application example 7 or 8, wherein a radial cross section of the electrode at a front end of the core portion has an area of 3.5 $mm^2$ or smaller.

Application Example 10

The spark plug described in any of the application examples 7 to 9, wherein at least one of the center electrode and the ground electrode has, as a radial cross section, a cross section in which the core portion, the cover portion, the core portion, the cover portion, and the core portion are arranged in this order on at least one straight line passing through a center of the cross section.

Application Example 11

The spark plug described in the application example 10, wherein at least one of the center electrode and the ground electrode has, as a radial cross section, a cross section in which the core portion, the cover portion, the core portion, the cover portion, and the core portion are arranged in this order on any straight line passing through the center of the cross section.

The present invention can be implemented in various forms. For example, the present invention may be implemented as a spark plug, a center electrode for a spark plug, a ground electrode for a spark plug, or a method of manufacturing these.

Advantageous Effects of the Invention

In the spark plug according to application example 1, since the core portion has a concave portion and a convex portion formed at the front end thereof, the area of contact between the core portion and the cover portion is relatively large, and a relatively large diffusion layer is formed between the core portion and the cover portion. The convex portion formed is such that, in a cross-section passing through the barycenter of the front end surface of the electrode and also passing through the convex portion, the area of the convex portion delimited by a line perpendicular to the bisector of the convex portion and passing through a point 0.2 mm shifted from the front end of the convex portion in the direction of the bisector is smaller than the area of a triangle formed by connecting the front end of the convex portion and intersections of the line perpendicular to the bisector and the contour of the convex portion. Such a convex portion (small convex portion) functions as a wedge for the cover portion. Therefore, in this spark plug, the occurrence of a gap between the cover portion and the core portion can be suppressed even during use under exposure to thermal cycles.

In the spark plug according to application example 2, the volume of the core portion on the front side of the electrode is relatively large. Therefore, the heat transfer performance of the electrode is improved, so that the occurrence of a gap between the cover portion and the core portion can be satisfactorily suppressed.

In the spark plug according to application example 3, the electrode has a cross-sectional area of 3.5 $mm^2$ or smaller. The heat capacity of such an electrode is small, and therefore a front gap is likely to occur during thermal cycles. However, in the above electrode, the occurrence of a gap between the cover portion and the core portion can be suppressed.

In the spark plug according to application example 4, the diameter reduction portion functions to prevent the cover portion from coming off. Also, due to the presence of the diameter reduction portion, the area of contact between the core portion and the cover portion increases further, so that the occurrence of a gap between the cover portion and the core portion can be satisfactorily suppressed.

In the spark plug according to application example 5, the area of contact between the core portion and the cover portion increases further, and the small convex portion is formed over a relatively large region in the radial cross section. Therefore, the occurrence of a gap between the cover portion and the core portion can be more satisfactorily suppressed.

In the spark plug according to application example 6, the area of contact between the core portion and the cover portion is still further increased, and the small convex portion is formed in a wide region extending over the entire circumference of the radial cross section. Therefore, the occurrence of a gap between the cover portion and the core portion can be very satisfactorily suppressed.

In the spark plug according to application example 7, since the concave portion is formed at the front end of the core portion, the area of contact between the core portion and the cover portion is relatively large, and a relatively large diffusion layer is formed between the core portion and the cover portion. In addition, the core portion has a diameter reduction portion tapered such that its diameter decreases toward the rear side. This diameter reduction portion functions to prevent the cover portion from coming off. Also, due to the presence of the diameter reduction portion, the area of contact between the core portion and the cover portion increases further. Therefore, in this spark plug, the occurrence of a gap between the cover portion and the core portion can be suppressed even during use under exposure to thermal cycles.

In the spark plug according to application example 8, the volume of the core portion on the front side of the electrode is relatively large. Therefore, the heat transfer performance of the electrode is improved, so that the occurrence of a gap between the cover portion and the core portion can be satisfactorily suppressed.

In the spark plug according to application example 9, the electrode has a cross-sectional area of 3.5 $mm^2$ or smaller. The heat capacity of such an electrode is small, and therefore a front gap is likely to occur during thermal cycles. However, in the above electrode, the occurrence of a gap between the cover portion and the core portion can be suppressed.

In the spark plug according to application example 10, the area of contact between the core portion and the cover portion is further increased. Therefore, the occurrence of a gap between the cover portion and the core portion can be very satisfactorily suppressed.

In the spark plug according to application example 11, the area of contact between the core portion and the cover portion is still further increased. Therefore, the occurrence of a gap between the cover portion and the core portion can be very satisfactorily suppressed.

BRIEF DESCRIPTION OF THE DRAWINGS

FIG. 4 Set of explanatory views illustrating the specific structure of the center electrode 20 near the front end of a core portion 25.

FIG. 13 Explanatory view illustrating examples of the results of evaluation of performance of center electrodes 20.

FIG. 16 Set of explanatory views illustrating the specific structures of center electrodes 20 of modified embodiments.

FIG. 17 Explanatory view illustrating the structure of a ground electrode 30 of a modified embodiment.

FIG. 18 Explanatory view illustrating the structure of the ground electrode 30 of the modified embodiment.

MODES FOR CARRYING OUT THE INVENTION

Modes for carrying out the invention will next be described on the basis of embodiments in the following order.

A. Embodiment
A-1. Structure of spark plug
A-2. Specific structure of center electrode for spark plug
A-3. Method of producing center electrode for spark plug
A-4. Performance evaluation
B. Modified embodiments

A. Embodiment

A-1. Structure of Spark Plug

Figure 1:
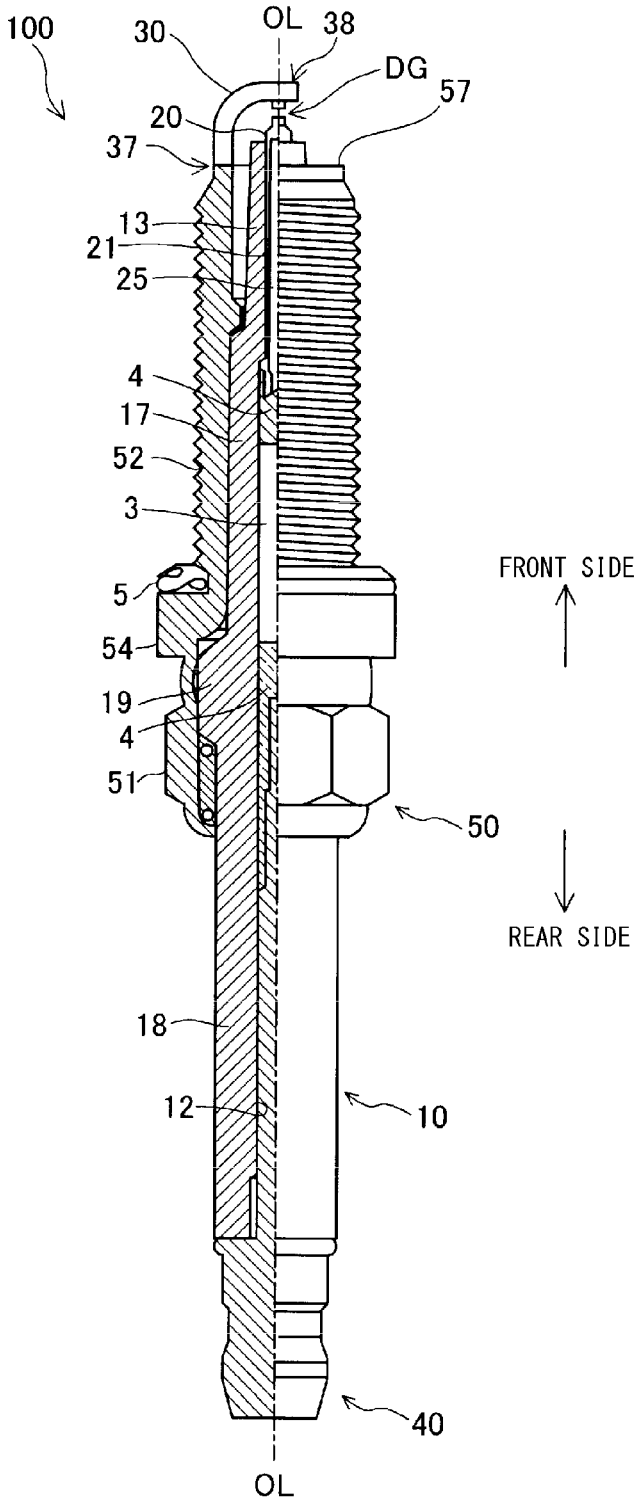
FIG. 1 Explanatory view illustrating the structure of a spark plug 100 according to an embodiment of the present invention.

FIG. 1 is an explanatory view illustrating the structure of a spark plug 100 according to an embodiment of the present invention. In FIG. 1, the side view of the spark plug 100 is shown on the right side of an axis OL, which is the center axis of the spark plug 100, and a cross-sectional view of the spark plug 100 is shown on the left side of the axis OL. In the following description, a side toward a discharge gap DG described later (a gap for spark discharge) is referred to as the front side of the spark plug 100 and a center electrode 20, and the side opposite to the front side is referred to as the rear side.

As shown in FIG. 1, the spark plug 100 includes a ceramic insulator 10, the center electrode 20, a ground electrode (outer electrode) 30, a metal terminal 40, and a metallic shell 50. The center electrode 20 is held by the ceramic insulator 10, and the ceramic insulator 10 is held by the metallic shell 50. The ground electrode 30 is attached to the front end of the metallic shell 50, and the metal terminal 40 is attached to the rear end of the ceramic insulator 10.

The ceramic insulator 10 is a tubular insulator having an axial bore 12 formed at the center thereof, and the axial bore 12 serves as a through hole for accommodating the center electrode 20 and the metal terminal 40. The ceramic insulator 10 is formed by firing a ceramic material such as alumina. The ceramic insulator 10 has a central trunk portion 19 formed near the center thereof in the direction of the axis OL and having a larger diameter than the other portions. A rear trunk portion 18 for insulation between the metal terminal 40 and the metallic shell 50 is formed rearward of the central trunk portion 19. A front trunk portion 17 is formed frontward of the central trunk portion 19, and a leg portion 13 smaller in outer diameter than the front trunk portion 17 is formed frontward of the front trunk portion 17.

The metallic shell 50 is a substantially cylindrical metallic member that surrounds a portion of the ceramic insulator 10 extending from a part of the rear trunk portion 18 to the leg portion 13 to hold the ceramic insulator 10. The metallic shell 50 is formed of a metal such as low carbon steel. The metallic shell 50 has a substantially cylindrical screw portion 52, and a screw thread that is to be threadingly engaged with a threaded hole of an engine head when the spark plug 100 is attached to the engine head is formed on the side surface of the screw portion 52. A front end surface 57, which is the front end surface of the metallic shell 50, has a hollow circular shape, and the front end of the leg portion 13 of the ceramic insulator 10 protrudes from the hollow portion of the front end surface 57. The metallic shell 50 further has a tool engagement portion 51 and a flange-like seal portion 54. When the spark plug 100 is attached to the engine head, a tool is engaged with the tool engagement portion 51. The seal portion 54 is formed rearward of the screw portion 52. An annular gasket 5 formed by bending a plate is fitted between the seal portion 54 and the engine head. The tool engagement portion 51 has, for example, a hexagonal cross-sectional shape.

The center electrode 20 is a substantially rod-shaped electrode having a cover portion 21 and a core portion 25 covered with the cover portion 21. A material having higher thermal conductivity than the material of the cover portion 21 is used as the material of the core portion 25. Therefore, the presence of the core portion 25 improves the heat transfer performance of the center electrode 20. The material of the core portion 25 and the material of the cover portion 21 are different in thermal expansion coefficient. In the present embodiment, a nickel alloy composed mainly of nickel is used as the material of the cover portion 21, and copper or an alloy composed mainly of copper is used as the material of the core portion 25. The center electrode 20 is accommodated in the axial bore 12 of the ceramic insulator 10 with the front end of the cover portion 21 protruding from the axial bore 12 of the leg portion 13 of the ceramic insulator 10 and is electrically connected through a ceramic resistor 3 and a seal body 4 to the metal terminal 40 disposed at the rear end of the ceramic insulator 10. An electrode tip formed of, for example, a noble metal may be joined to the front end of the center electrode 20, in order to improve resistance to spark-induced erosion and resistance to oxidation-induced erosion.

The ground electrode 30 is a substantially rod-shaped bent electrode. The ground electrode 30 has a base end portion 37 at one end that is joined to the front end surface 57 of the metallic shell 50 and a distal end portion 38 at the other end that is bent so as to face the front end portion of the center electrode 20. A gap for spark discharge (a discharge gap DG) is formed between the distal end portion 38 of the ground electrode 30 and the front end portion of the center electrode 20. An electrode tip formed of, for example, a noble metal may be joined to the distal end portion 38 of the ground electrode 30 on the side facing the center electrode 20, in order to improve resistance to spark-induced erosion and resistance to oxidation-induced erosion.

A-2. Specific Structure of Center Electrode for Spark Plug

Figure 2:
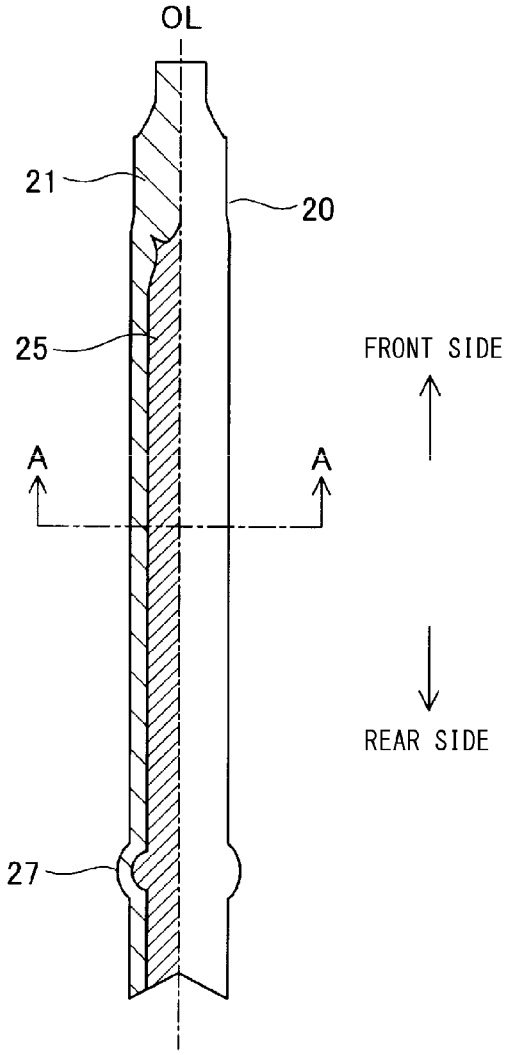
FIG. 2 Explanatory view illustrating the specific structure of a center electrode 20 for the spark plug 100.
Figure 3:
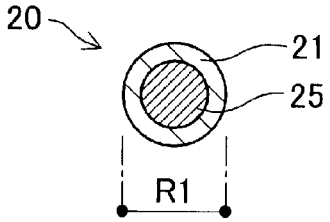
FIG. 3 Explanatory view illustrating the specific structure of the center electrode 20 for the spark plug 100.

FIGS. 2 and 3 are explanatory views illustrating the specific structure of the center electrode 20 for the spark plug 100. In FIG. 2, the side view of the center electrode 20 is shown on the right side of the axis OL, and the view of a cross section parallel to the axis OL of the center electrode 20 (more specifically, a cross section including the axis OL) is shown on the left side of the axis OL. In FIG. 3, the view of a cross section perpendicular to the axis OL at position A-A in FIG. 2 (i.e., a radial cross section) is shown. As shown in FIG. 2, the center electrode 20 is a substantially rod-shaped electrode extending along the axis OL. As shown in FIG. 3, the radial cross section of the center electrode 20 has a circular shape. In the present embodiment, the diameter R1 of a radial cross section of the center electrode 20 at the front end of the core portion 25 is 2.1 mm or smaller. Specifically, the radial cross-sectional area of the center electrode 20 at this position is 3.5 $mm^2$ or smaller. As described above, the center electrode 20 of the present embodiment is an electrode having a relatively small diameter. The center electrode 20 includes portions having diameters different from that at the front end of the core portion 25, such as the frontmost end portion and a support portion 27.

As shown in FIGS. 2 and 3, the center electrode 20 of the present embodiment has a structure in which the core portion 25 is covered with the cover portion 21. The phrase "the core portion 25 is covered with the cover portion 21" means that at least part of the outer surface of the core portion 25 is covered with the cover portion 21. In the present embodiment, the cover portion 21 covers the front end portion and side portion of the core portion 25, but the rear end surface of the core portion 25 is not covered with the cover portion 21 and is exposed.

The flange-shaped support portion 27 protruding in a direction perpendicular to the axis OL is formed near the rear end of the center electrode 20. As shown in FIG. 1, the support portion 27 of the center electrode 20 is supported by a step at the boundary between the front trunk portion 17 and the leg portion 13 within the axial bore 12 of the ceramic insulator 10.

FIG. 4 is a set of explanatory views illustrating the specific structure of the center electrode 20 near the front end portion of the core portion 25. FIG. 4(*a*) shows the view of a cross section of the center electrode 20 near the front end portion of the core portion 25, the cross section being taken parallel to the axis OL (a cross section including the axis OL). FIG. 4(*b*) shows the view of a cross section perpendicular to the axis OL at position B-B in FIG. 4(*a*) (a radial cross section).

As shown in FIGS. 4(*a*) and 4(*b*), the front end portion of the core portion 25 has a concave-convex shape. Specifically, a front end concave portion DPt is formed at the front end of the core portion 25, and convex portions (a central convex portion CPm and an edge convex portion CPe) are formed with the front end concave portion DPt interposed therebetween. The central convex portion CPm is formed in the vicinity of the center of the front end portion of the core portion 25 (in the vicinity of the axis OL), and the edge convex portion CPe is formed at the circumferential edge of the front end portion of the core portion 25. The depth d of the concave portion formed at the front end of the core portion 25 is preferably 0.1 mm or larger, more preferably 0.2 mm or larger.

As shown in FIG. 4(*b*), in the cross section (radial cross section) of the center electrode 20 taken perpendicular to the axis OL at position B-B, the core portion 25, the cover portion 21, the core portion 25, the cover portion 21, and the core portion 25 are arranged in this order on any line passing through the center CG of the cross section (a point on the axis OL in the present embodiment). This means that the edge convex portion CPe has a portion continuous over 360° about the axis OL so as to surround the central convex portion CPm. The height of the edge convex portion CPe in the direction of the axis OL is not necessarily constant throughout 360°. For example, in a radial cross section of the center electrode 20 at a position frontward of position B-B, the edge convex portion CPe may not be continuous over 360° about the axis OL, i.e., may be discontinuous, or may be divided into a plurality of sections.

Figure 5:
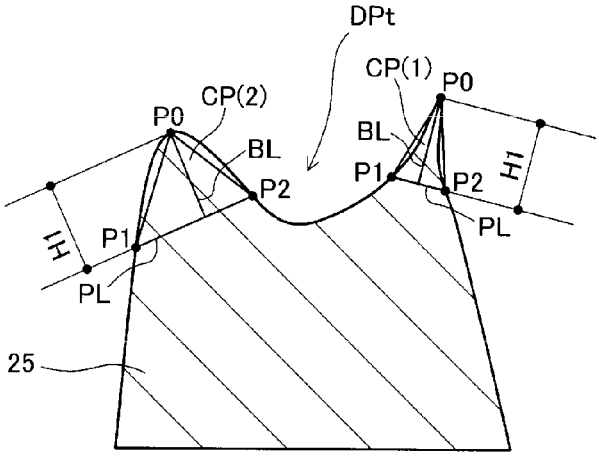
FIG. 5 Explanatory view illustrating the difference between a small convex portion and a large convex portion.

In the present description, a convex portion CP at the front end of the core portion 25 is classified as a small convex portion or a large convex portion. FIG. 5 is an explanatory view illustrating the difference between the small convex portion and the large convex portion. FIG. 5 shows a cross section of the core portion 25 that passes through the barycenter of the front end surface of the center electrode 20 (a point on the axis OL in the present embodiment) and also passes through convex portions CP. In the cross-section shown in FIG. 5, two convex portions CP (a convex portion CP(1) and a convex portion CP(2)) appear with a front end concave portion DPt interposed therebetween. As shown in FIG. 5, the first convex portion CP(1) meets the following condition 1. In the present description, a convex portion CP that meets condition 1 is referred to as a small convex portion.

<Condition 1>

In at least one cross section of the core portion 25 that passes through the barycenter of the front end surface of the center electrode 20 and also passes through a convex portion CP, the area of the convex portion CP delimited by a line PL perpendicular to the bisector BL of the convex portion CP and passing through a point located at a distance H1 (=0.2 mm) from the front end P0 of the convex portion CP in the direction of the bisector BL is smaller than the area of a triangle formed by connecting the front end P0 of the convex portion CP and intersections P1 and P2 of the line PL perpendicular to the bisector BL and the contour of the convex portion CP (i.e., a triangle P0-P1-P2).

The second convex portion CP(2) does not meet condition 1. In the present description, such a convex portion CP that does not meet condition 1 is referred to as a large convex portion. The small convex portion can also be expressed as a thin convex portion or a sharp convex portion, and the large convex portion can also be expressed as a thick convex portion or a blunt convex portion.

In the center electrode 20 shown in FIG. 4, among the convex portions formed at the front end of the core portion 25, at least part of the edge convex portion CPe is a small convex portion. More specifically, in at least one cross section of the core portion 25 that passes through a point on the axis OL and also passes through the convex portions CP, the edge convex portion CPe meets the above-described condition 1. The central convex portion CPm is a large convex portion.

In the center electrode 20 shown in FIG. 4, the core portion 25 has a diameter reduction portion SR. The diameter reduction portion SR is tapered such that its diameter decreases toward the rear side. More specifically, the core portion 25 has, at a position frontward of the diameter reduction portion SR having a diameter W0, a portion having a diameter larger than W0 (the edge convex portion CPe in the example in FIG. 4).

In the core portion 25 of the center electrode 20 shown in FIG. 4, the extent of a reduction in volume on the front side relative to the volume on the rear side is suppressed. More specifically, the ratio of the diameter W1 of the core portion 25 at a position located at a distance L1 (=1 mm) from the front end position PT of the core portion 25 in the direction of the axis OL (the direction perpendicular to the diameter of the center electrode 20) to the diameter W2 of the core portion 25 at a position located at a distance L2 (=5 mm) from the front end position PT in the direction of the axis OL (this ratio is referred also to as the diameter ratio "W1/W2") is 0.6 or larger.

Figure 6:
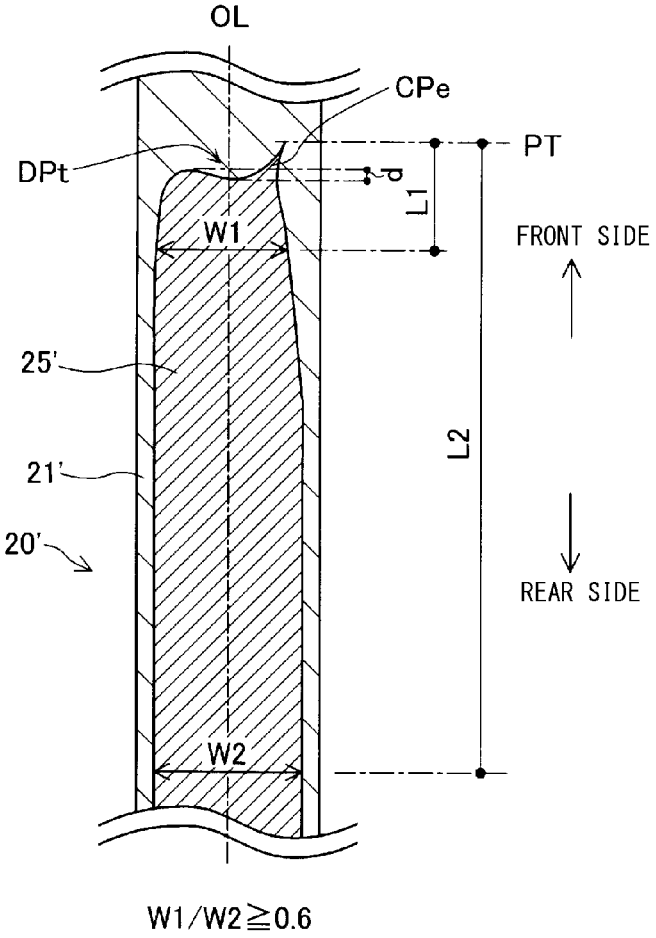
FIG. 6 Explanatory view illustrating another example of the center electrode 20.

FIG. 6 is an explanatory view illustrating another example of the center electrode 20. FIG. 6 shows the view of a cross section of a center electrode 20' near the front end portion of a core portion 25', the cross section being taken parallel to the axis OL (a cross section including the axis OL), as does FIG. 4(*a*). The center electrode 20' shown in FIG. 6 has a circular radial cross having a diameter R1 (R1 is 2.1 mm or smaller) and has a structure in which the core portion 25' is covered with the cover portion 21', as does the center electrode 20 shown in FIG. 4. The front end portion of the core portion 25' has a concave-convex shape. In the center electrode 20' shown in FIG. 6, although a front end concave portion DPt and an edge convex portion CPe surrounding the front end concave portion DPt are formed at the front end of the core portion 25', no convex portion is formed in the vicinity of the center of the front end portion of the core portion 25' (in the vicinity of the axis OL). A part of the edge convex portion CPe shown on the right side of the axis OL in the cross section in FIG. 6 is a small convex portion. In the center electrode 20' shown in FIG. 6, as in the center electrode 20 shown in FIG. 4, the diameter ratio W1/W2 is 0.6 or larger. In the center electrode 20' shown in FIG. 6, the core portion 25' does not have the diameter reduction portion SR. In the present description, when examples and comparative examples are distinguished from each other in the following description, a distinguishing symbol such as "'" is added to the end of the reference numeral of each component. When a description common to these examples and comparative examples is given, the distinguishing symbol is appropriately omitted.

Figure 7:
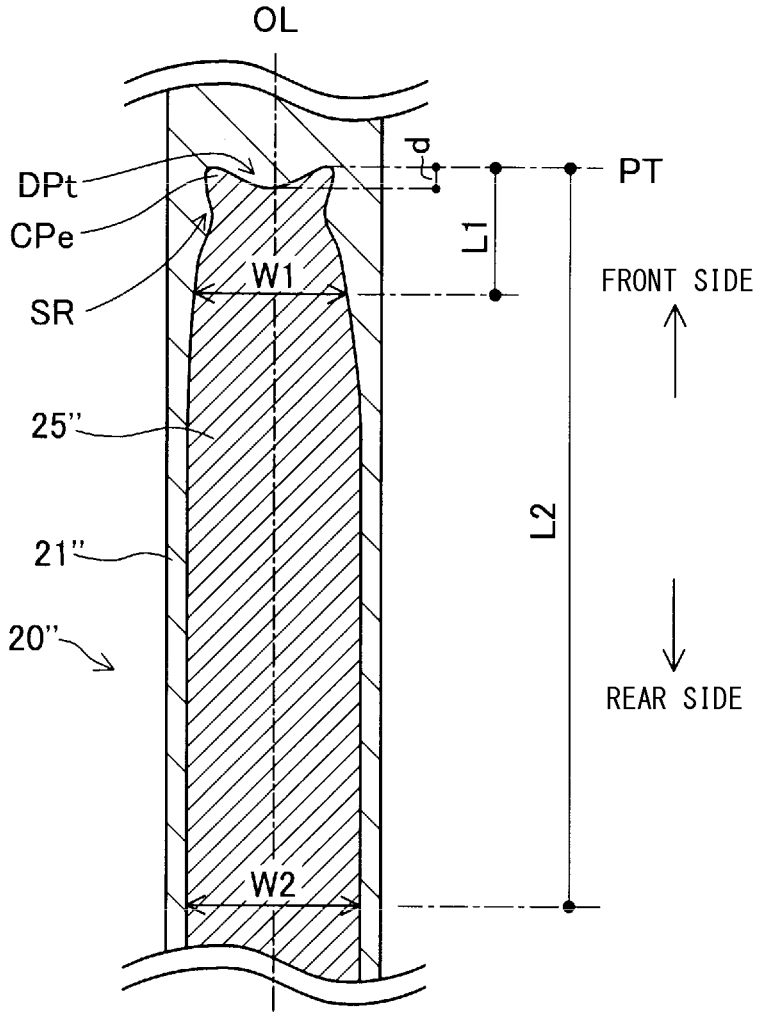
FIG. 7 Explanatory view illustrating another example of the center electrode 20.

FIG. 7 is an explanatory view illustrating another example of the center electrode 20. FIG. 7 shows the view of a cross section of a center electrode 20" near the front end portion of a core portion 25", the cross section being taken parallel to the axis OL (a cross section including the axis OL), as does FIG. 4(*a*). The center electrode 20" shown in FIG. 7 has a circular radial cross section having a diameter R1 (R1 is 2.1 mm or smaller) and has a structure in which the core portion 25" is covered with the cover portion 21", as does the center electrode 20 shown in FIG. 4. The front end portion of the core portion 25" has a concave-convex shape. In the center electrode 20" shown in FIG. 7, although a front end concave portion DPt and an edge convex portion CPe surrounding the front end concave portion DPt are formed at the front end of the core portion 25", no convex portion is formed in the vicinity of the center of the front end portion of the core portion 25" (in the vicinity of the axis OL). The edge convex portion CPe is a large convex portion. In the center electrode 20" shown in FIG. 7, as in the center electrode 20 shown in FIG. 4, the diameter ratio W1/W2 is 0.6 or larger. In the center electrode 20" shown in FIG. 7, the core portion 25" has a diameter reduction portion SR tapered such that its diameter decreases toward the rear side.

A-3. Method of Producing Center Electrode for Spark Plug

Figure 8:
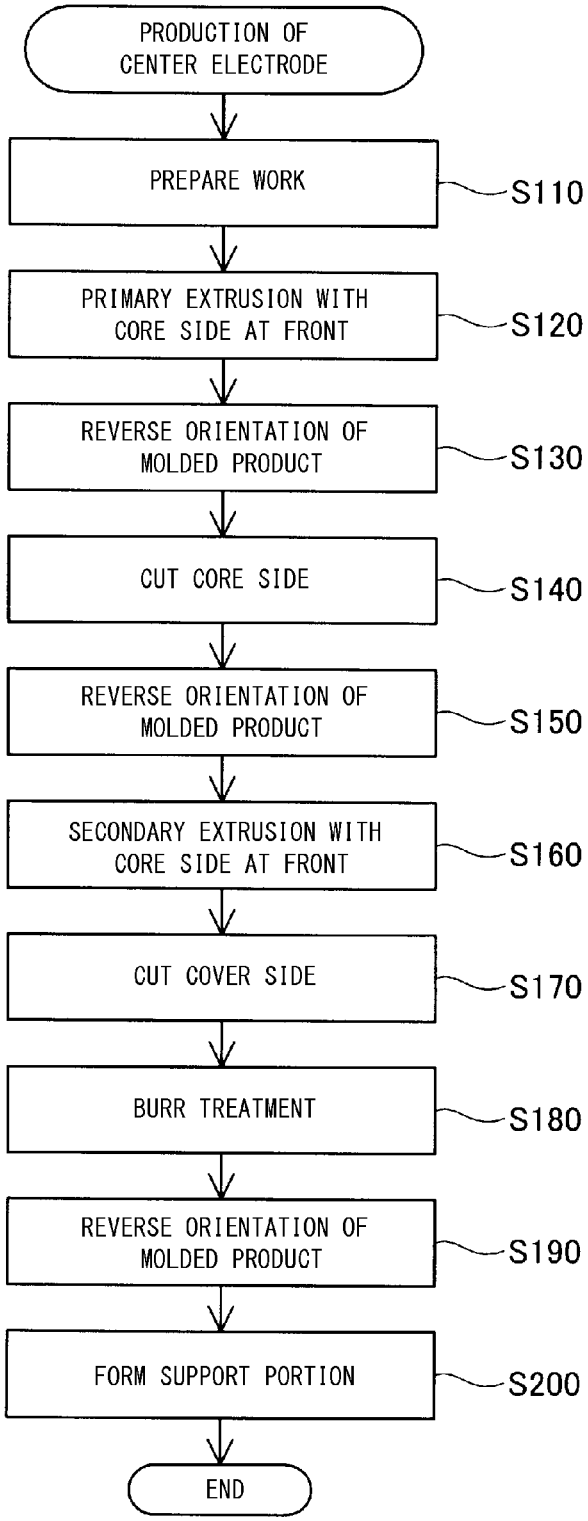
FIG. 8 Flowchart showing a method of producing the center electrodes 20 of the present embodiment.
Figure 9:
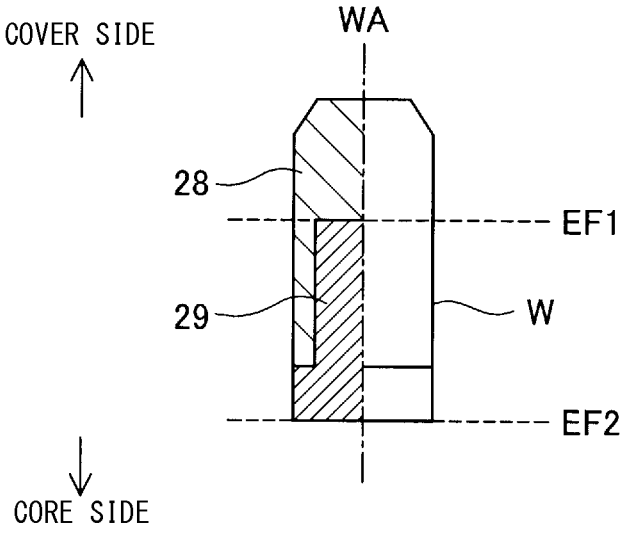
FIG. 9 Explanatory view illustrating the method of producing the center electrode 20 of the present embodiment.
Figure 10:
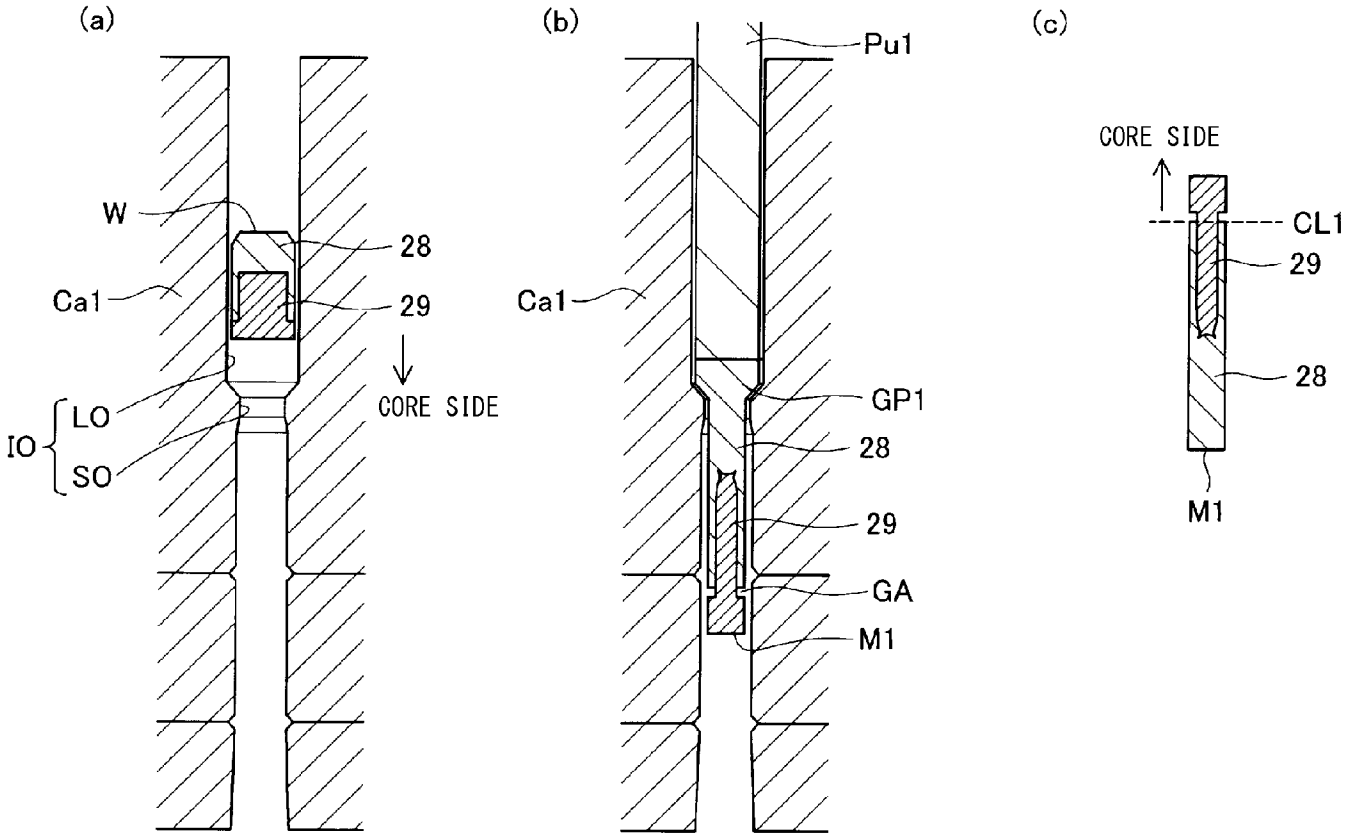
FIG. 10 Set of explanatory views illustrating the method of producing the center electrodes 20 of the present embodiment.
Figure 11:
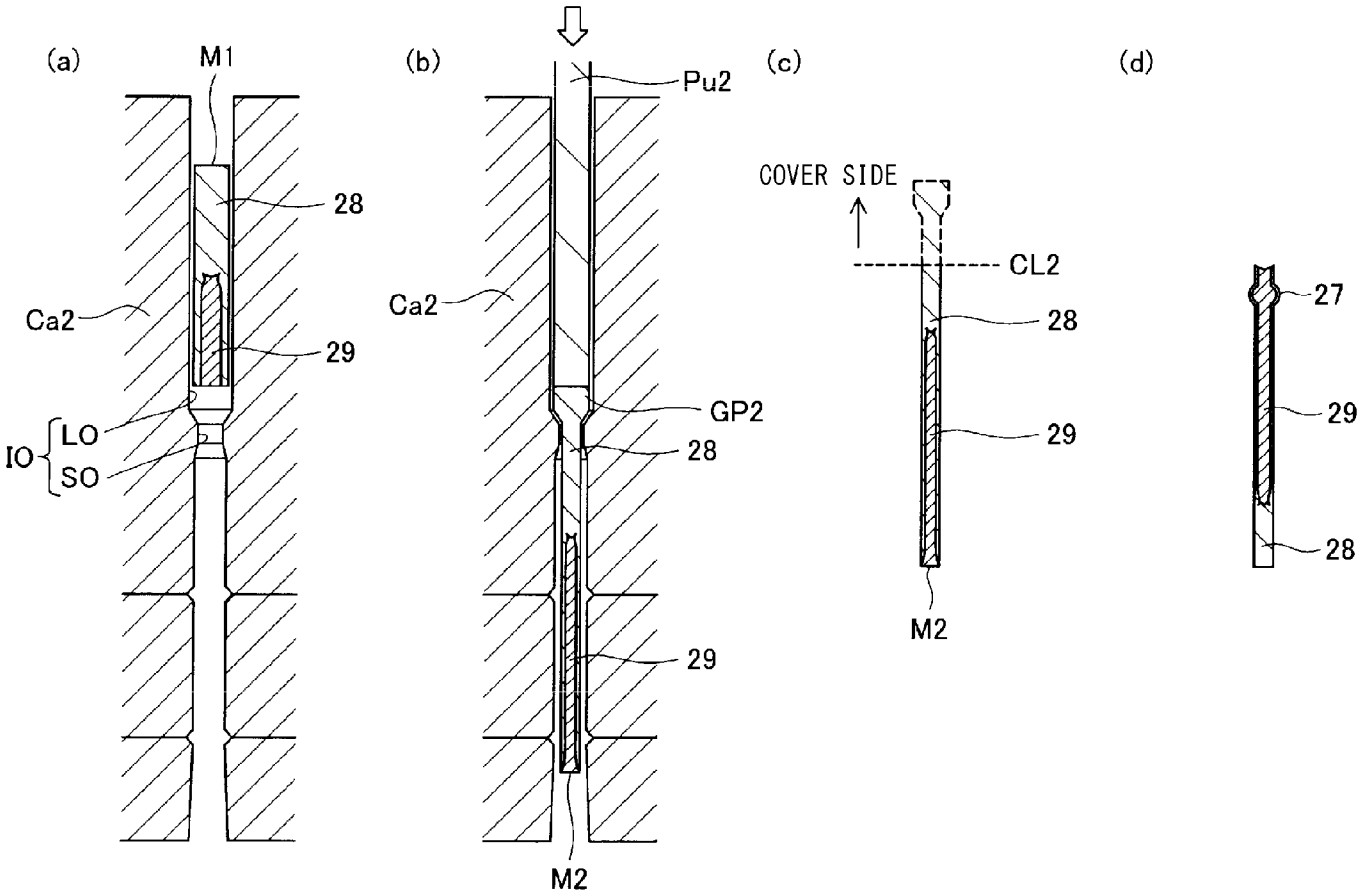
FIG. 11 Set of explanatory views illustrating the method of producing the center electrodes 20 of the present embodiment.

FIG. 8 is a flowchart showing a method of producing the center electrode 20 of the present embodiment. FIGS. 9 to 11 are explanatory views illustrating the method of producing the center electrode 20 of the present embodiment. When a center electrode 20 is produced, a work W used as a starting member is first prepared (step S110). FIG. 9 shows the structure of the work W used to produce the center electrode 20 of the present embodiment. In FIG. 9, the side view of the work W is shown on the right side of a work axis WA, which is the center axis of the work W, and the cross-sectional view of the work W is shown on the left side of the work axis WA.

The work W is formed into a columnar shape about the work axis WA. Since the center electrode 20 of the present embodiment is composed of the cover portion 21 and the core portion 25 as described above, the work W is formed from a cover material 28 used as the material for forming the cover portion 21 and a core material 29 used as the material for forming the core portion 25. The cover material 28 covers a first end face EF1 of the core material 29, which is one end surface thereof, and at least part of the side face continuous with the first end face EF1 but does not cover a second end face EF2 of the core material 29, which is the other end surface thereof. More specifically, the work W is such that the end face of the cover material 28 toward the second end face EF2 is covered with the core material 29. In the following description, the side of the work W toward the first end face EF1 (the side on which the cover material 28 forms an end portion) is referred to as a cover side, and the side toward the second end face EF2 (the side on which the core material 29 forms an end portion) is referred to as a core side. The method of producing the work W having the structure shown in FIG. 9 is described in, for example, Japanese Patent Application Laid-Open (kokai) No. H04-294085 and is well-known, and therefore the description thereof will be omitted.

Next, the work W is subjected to first extrusion molding (primary extrusion molding) using a die Ca1 to produce a primary molded product M1 (step S120 in FIG. 8). As shown in FIGS. 10(*a*) and 10(*b*), the die Ca1 used for the primary extrusion molding has an inner hole IO, and the inner hole IO has a small-diameter hole portion SO and a large-diameter hole portion LO larger in diameter than the small-diameter hole portion SO. When the primary extrusion molding is performed, the work W is inserted core side first into the large-diameter hole portion LO of the die Ca1 (FIG. 10(*a*)) and pressed toward the small-diameter hole portion SO using a punch Put (FIG. 10(*b*)). The primary molded product M1 produced by the primary extrusion molding includes a small-diameter portion having an outer diameter substantially the same as the inner diameter of the small-diameter hole portion SO of the die Ca1 and a large-diameter portion GP1 exposed from the small-diameter portion. As shown in FIG. 10(*b*), as a result of the primary extrusion molding, a portion (a concave-convex shape) that later becomes the front end concave portion DPt and the edge convex portion CPe (see FIG. 4(*a*)) is formed at the cover-side end of the core material 29 in the primary molded product M1. As a result of the primary extrusion molding, a portion that later becomes the diameter reduction portion SR may be formed in the core material 29 of the primary molded product M1. When the primary extrusion molding is performed using a die Ca1 having a cross-sectional reduction ratio (the cross-sectional area of the small-diameter hole portion SO/the cross-sectional area of the large-diameter hole portion LO) of 50% or higher, the portion that later becomes the front end concave portion DPt and the edge convex portion CPe and the portion that later becomes the diameter reduction portion SR can be formed with at least a certain probability.

In the primary molded product M1, an end face of the cover material 28 and a surface of a part of the core material 29 that protrudes from the cover material 28 are separated from each other at the core-side end of the primary molded product M1, and a gap GA is present therebetween. This gap GA can be formed by, for example, subjecting the work W to heat treatment under controlled heat treatment conditions before insertion into the die Ca1 so that the thickness of a diffusion layer at the boundary between the core material 29 and the cover material 28 is controlled (the thickness of the diffusion layer is controlled to, for example, about 5 μm). As described above, the primary extrusion molding is performed such that the gap GA is formed in the primary molded product M1. In this case, the core material 29 presses the end face of the cover material 28 in the cover-side end portion of the primary molded product M1, and therefore formation of a gap near the boundary between the core material 29 and the cover material 28 in the core-side end portion of the primary molded product M1 can be suppressed. After the primary extrusion molding, the primary molded product M1 is kicked out and removed from the die Ca1.

Next, the orientation of the removed primary molded product M1 is reversed (step S130 in FIG. 8), and a core-side portion of the primary molded product M1 is cut (step S140 in FIG. 8), as shown in FIG. 10(*c*). A cutting line CL1 for this cutting is located in the vicinity of the end surface of the cover material 28 on the core side of the primary molded product M1.

Next, the orientation of the primary molded product M1 is again reversed (step S150 in FIG. 8), and the primary molded product M1 is used as a work and subjected to second extrusion molding (secondary extrusion molding) using a die Ca2 to produce a secondary molded product M2 (step S160 in FIG. 8). As shown in FIGS. 11(*a*) and 11(*b*), the die Ca2 used for the secondary extrusion molding has an inner hole IO, and the inner hole IO has a small-diameter hole portion SO and a large-diameter hole portion LO larger in diameter than the small-diameter hole portion SO, as in the die Ca1 used for the primary extrusion molding. In the secondary extrusion molding, as in the primary extrusion molding, the primary molded product M1 used as the work is inserted core side first into the large-diameter hole portion LO of the die Ca2 (FIG. 11(*a*)) and pressed toward the small-diameter hole portion SO using a punch Pu2 (FIG. 11(*b*)). The secondary molded product M2 produced by the secondary extrusion molding includes a small-diameter portion having an outer diameter substantially the same as the inner diameter of the small-diameter hole portion SO of the die Ca2 and a large-diameter portion GP2 exposed from the small-diameter portion. As shown in FIG. 11(*b*), the portion (the concave-convex shape) later becoming the front end concave portion DPt and the edge convex portion CPe and the portion later becoming the diameter reduction portion SR that have been formed by the primary extrusion molding are maintained in the secondary molded product M2. After the secondary extrusion molding, the secondary molded product M2 is kicked out and removed from the die Ca2.

Next, as shown in FIG. 11(*c*), a cover-side portion of the removed secondary molded product M2 is cut (step S170 in FIG. 8). A cutting line CL2 for this cutting is set such that the distance from the front end of the core material 29 to the front end of the cover material 28 on the cover-side of the secondary molded product M2 becomes a prescribed distance. The prescribed distance is set in advance according to the front-side structure of the center electrode 20 to be produced (FIG. 2).

Next, burr treatment is performed on the cover side of the secondary molded product M2 (step S180 in FIG. 8). During cutting treatment performed on the secondary molded product M2 (step S170 in FIG. 8), burrs extending in the cutting direction (i.e., the direction substantially perpendicular to the axial direction) may be formed on the cut surface. The burr treatment is treatment for removing the formed burrs or changing the direction of the burrs to a direction parallel to the axial direction.

Next, the orientation of the secondary molded product M2 is reversed (step S190 in FIG. 8), and a final step is performed to form a support portion 27 on the secondary molded product M2 as shown in FIG. 11(*d*). The formation of the support portion 27 is carried out by, for example, subjecting the secondary molded product M2 after the cutting step to extrusion molding using a die. During this extrusion molding, the front-most end portion of the secondary molded product M2 is also slightly reduced in diameter (drawn). As a result of this processing, a central convex portion CPm (see FIG. 4(*a*)) is formed at the cover-side end of the core material 29 of the molded product, as shown in FIG. 11(*d*). During the extrusion molding for forming the support portion 27, the processing for reducing the diameter of the frontmost end portion of the secondary molded product M2 is not necessarily performed. Therefore, the central convex portion CPm is not necessarily formed on the molded product. When the support portion 27 is molded, the production of the center electrode 20 is completed. In some cases, cutting and processing for joining a tip may be performed after the formation of the support portion 27. In such a case, after the support portion 27 is molded, production of a center electrode intermediate that later becomes the center electrode 20 is completed.

With the production method described above, the center electrode 20 shown in FIG. 4 can be produced. More specifically, this production method can produce the center electrode 20 in which the central convex portion CPm, the edge convex portion CPe, and the front end concave portion DPt are formed at the front end of the core portion 25, in which the edge convex portion CPe has a portion continuous over 360° about the axis OL, in which at least part of the edge convex portion CPe is a small convex portion, in which the core portion 25 has the diameter reduction portion SR, and in which the diameter ratio W1/W2 is 0.6 or larger. However, in the produced center electrode 20, according to the materials used, the size of each portion, the conditions for each step, etc., the central convex portion CPm may not be formed (FIGS. 6 and 7), the edge convex portion CPe may not have a portion continuous over 360° about the axis OL, the edge convex portion CPe may become a large convex portion (FIG. 7), the diameter reduction portion SR may not be formed (FIG. 6), or the diameter ratio W1/W2 may become smaller than 0.6.

A-4. Performance Evaluation

Figure 12:
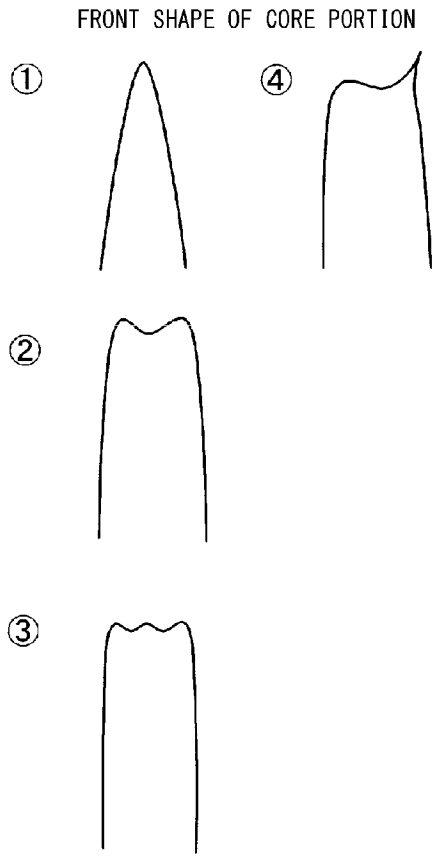
FIG. 12 Explanatory view illustrating examples of the results of evaluation of performance of center electrodes 20.

Performance evaluation was performed on the center electrode 20 of the above-described embodiment and on a center electrode 20 of a comparative example which will be described below. FIGS. 12 and 13 are explanatory views showing examples of the results of evaluation of the performance of the center electrodes 20.

Figure 14:
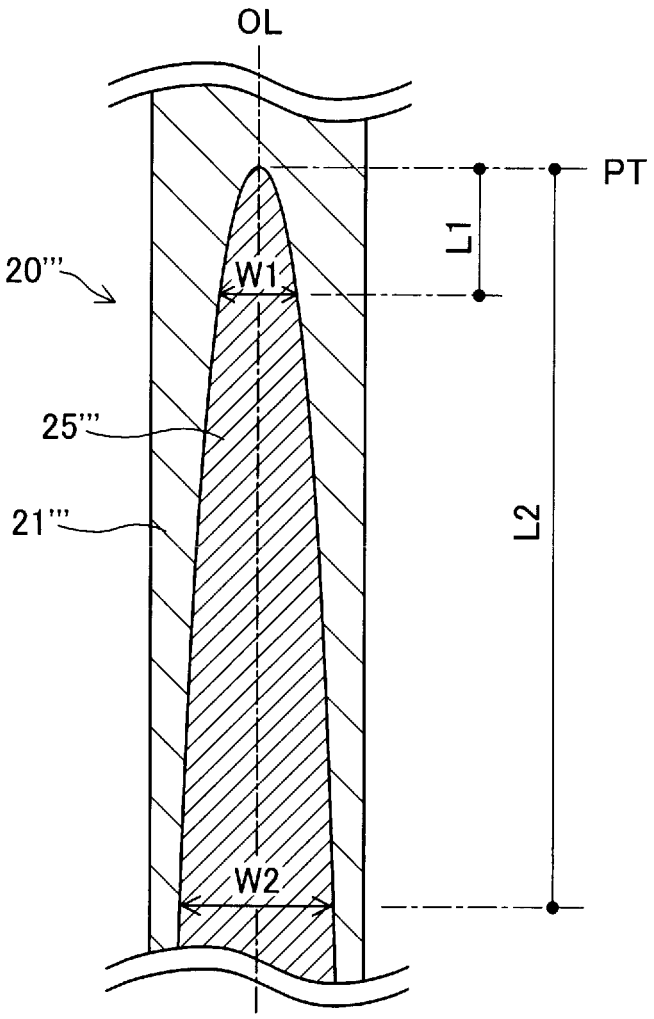
FIG. 14 Explanatory view illustrating the structure of a center electrode 20 of a comparative example.

FIG. 14 is an explanatory view illustrating the structure of a center electrode 20 of the comparative example. FIG. 14 shows the view of a cross section of the center electrode 20''' near the front end portion of a core portion 25''', the cross section being taken parallel to the axis OL (a cross section including the axis OL), as does FIG. 4(*a*). The center electrode 20''' of this comparative example is produced by a method different from the method of producing the center electrodes 20 of the above-described embodiment. More specifically, in the method of producing the center electrode 20''' of the comparative example, a work W and a molded product M are inserted cover side first, instead of core side first as in the above embodiment, into dies Ca during extrusion molding (steps S120 and S160 in FIG. 8). As a result of the extrusion molding, the core materials 29 in the work W and the molded product M are tapered such that their diameters decrease toward their cover-side end portions. Therefore, the core portion 25''' has a tapered shape on the front side of the center electrode 20''' (the diameter ratio W1/W2 is smaller than 0.6) as shown in FIG. 14. In the center electrode 20''' of the comparative example, no concave portion is formed at the front end of the core portion 25''' (i.e., the front end portion of the core portion 25''' has a simple convex shape), and also no diameter reduction portion SR is formed.

FIG. 12 shows the results of a first thermal test performed on 14 samples (samples Nos. 1-14) with different combinations of the front end shape of the core portion 25 and the radial cross-sectional area of the center electrode 20 at the front end of the core portion 25. The center electrodes 20 in the samples had any of four radial cross-sectional areas, 4.2 $mm^2$, 3.8 $mm^2$, 3.5 $mm^2$, and 3.1 $mm^2$. The core portions 25 of the center electrodes 20 in the samples had any of four front end shapes of types 1 to 4 shown in FIG. 12. The front end shape of type 1 is a shape corresponding to the core portion 25''' of the center electrode 20''' of the comparative example shown in FIG. 14. In the front end shape of type 2, although the front end concave portion DPt and the edge convex portion CPe are formed, no central convex portion CPm is formed. The edge convex portion CPe is a large convex portion, and no diameter reduction portion SR is formed. In the front end shape of type 3, the front end concave portion DPt, the central convex portion CPm, and the edge convex portion CPe are formed. However, the edge convex portion CPe and the central convex portion CPm are large convex portions, and no diameter reduction portion SR is formed. In the front end shape of type 4 (corresponding to the example shown in FIG. 6), although the front end concave portion DPt and the edge convex portion CPe are formed, no central convex portion CPm is formed. At least part of the edge convex portion CPe is a small convex portion, and no diameter reduction portion SR is formed.

Figure 15:
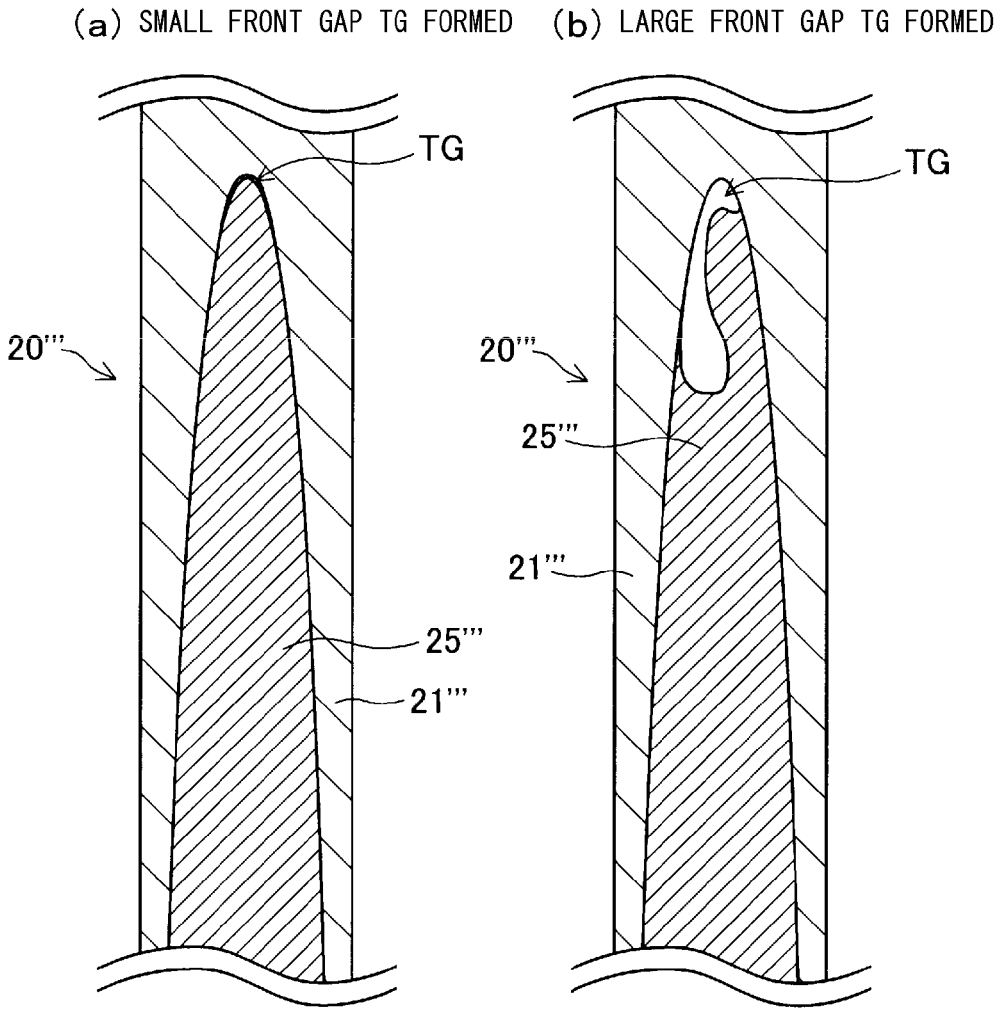
FIG. 15 Set of explanatory views illustrating examples of the center electrode 20 with a front gap TG formed.

In the first thermal test, the front end portion of each center electrode 20 was heated for 2 minutes using a burner and then cooled for 1 minute, and this cycle was repeated 1,000 times. The temperature setting used was such that the temperature of the front end of the center electrode 20 of sample No. 8 reached 800° C. Then a cross section of the center electrode 20 was observed visually and under a microscope (magnification: 30×) to judge whether or not a gap (front gap TG) occurred between the cover portion 21 and the core portion 25 on the front side. Each sample was rated as follows. A sample in which no front gap TG occurred was rated good (indicated by a circle). A sample in which a small front gap TG (a gap of 0.1 mm or smaller) occurred was rated fair (indicated by a triangle). A sample in which a large front gap TG (a gap of larger than 0.1 mm) occurred was rated poor (indicated by a cross). FIG. 15 is a set of explanatory views illustrating examples of the center electrode 20 with a front gap TG formed. FIG. 15(*a*) shows an exemplary center electrode 20''' with a small front gap TG formed, and FIG. 15(*b*) shows an exemplary center electrode 20''' with a large front gap TG formed.

In the first thermal test, no front gap TG occurred in samples (samples Nos. 1 to 7) in which the radial cross section of the center electrode 20 at the front end of the core portion 25 had an area larger than 3.5 $mm^2$, irrespective of the type of the front end shape of the core portion 25, as shown in FIG. 12. However, in samples (samples Nos. 8 to 14) in which the radial cross-sectional area of the center electrode 20 was 3.5 $mm^2$ or smaller, a large front gap TG occurred in samples with the front shape of type 1 (samples Nos. 8 and 12). When the radial cross-sectional area of the center electrode 20 is small, its heat capacity is low, so that a front gap TG is likely to occur during thermal cycles. The results of the first thermal test show that when the radial cross-sectional area of the center electrode 20 is larger than 3.5 $mm^2$, the problem of occurrence of a front gap TG is less likely to occur irrespective of the front end shape of the core portion 25 and that when the radial cross-sectional area of the center electrode 20 is 3.5 $mm^2$ or smaller, the problem of occurrence of a front gap TG is more likely to occur.

As can be seen from the results of the first thermal test, when the front end portion of the core portion 25 of the center electrode 20 has a concave-convex shape (a concave portion and a convex portion are formed at the front end), the occurrence of a front gap TG is suppressed as compared with the case in which the front end portion of the core portion 25 does not have a concave-convex shape (the front end portion has a simple convex shape). This may be because of the following reason. When the front end portion of the core portion 25 of the center electrode 20 has a concave-convex shape, the area of contact between the core portion 25 and the cover portion 21 becomes relatively large, and a relatively large diffusion layer is formed therebetween, so that the occurrence of a front gap TG is suppressed.

FIG. 13 shows the results of a second thermal test performed on ten samples (samples Nos. 15 to 24). In these samples, the radial cross-sectional areas of the center electrodes 20 were the same, 3.5 $mm^2$. However, these samples were different in the front end shape of the core portion 25, the value of the diameter ratio W1/W2, and the presence or absence of a small convex portion. The core portions 25 in the samples used for the second thermal test had any of six front end shapes of types 1 to 6. The front end shapes of types 1 to 4 are the same as types 1 to 4 in the first thermal test described above. In the front end shape of type 5 (corresponding to the example shown in FIG. 7), although the front end concave portion DPt and the edge convex portion CPe are formed, no central convex portion CPm is formed. The edge convex portion CPe is a large convex portion, and the diameter reduction portion SR is formed. In the front end shape of type 6 (corresponding to the example shown in FIG. 4), the front end concave portion DPt, the central convex portion CPm, and the edge convex portion CPe are formed. At least part of the edge convex portion CPe is a small convex portion, and the diameter reduction portion SR is formed. Samples with front end shapes of types 1 to 3 and 5 have no small convex portion, and samples with front end shapes of types 4 and 6 have a small convex portion.

In the second thermal test, the front end portion of each center electrode 20 was heated for 2 minutes using a burner and then cooled for 1 minute, and this cycle was repeated. The temperature setting used was such that the temperature of the front end of the center electrode 20 of sample No. 15 reached 850° C. A cross-section of the center electrode 20 was observed visually and under a microscope after 1,000 cycles, 1,500 cycles, and 2,000 cycles to judge whether or not a front gap TG occurred between the cover portion 21 and the core portion 25 on the front side. As described above, the second thermal test was performed to examine whether or not a front gap TG occurred under severer conditions than those in the first thermal test described above.

In the second thermal test, the occurrence of a large front gap TG was found after 1,000 cycles in samples with the front end shape of type 1 (samples Nos. 15 and 16) and a sample with the front end shape of type 2 and having a value of the diameter ratio W1/W2 of 0.5 (sample No. 17), as shown in FIG. 13. In a sample with the front end shape of type 2 and having a value of the diameter ratio W1/W2 of 0.6 (sample No. 18) and a sample with the front end shape of type 3 and having a value of the diameter ratio W1/W2 of 0.6 (sample No. 19), the occurrence of a small gap TG was found after 1,000 cycles, and the occurrence of a large front gap TG was found after 1,500 cycles. These results show that when the front end shapes are of types 1 to 3, the problem of occurrence of a front gap TG occurs irrespective of the value of the diameter ratio W1/W2.

In a sample having a value of the diameter ratio W1/W2 of 0.5 (sample No. 20) among samples with the front end shape of type 4, the occurrence of a front gap TG was not found after 1,000 cycles, but the occurrence of a small front gap TG was found after 1,500 cycles. However, the front gap TG formed was small even after 2,000 cycles. In a sample having a value of the diameter ratio W1/W2 of 0.6 (sample No. 21) among the samples with the front end shape of type 4, the occurrence of a front gap TG was not found after 1,500 cycles, and a front gap TG formed was small even after 2,000 cycles. These results show that when a concave portion and a convex portion are formed at the front end of the core portion 25 and at least part of the convex portion is a small convex portion, the occurrence of a front gap TG can be suppressed. This may be because the concave-convex shape of the front end portion of the core portion 25 provides the effect of increasing the area of contact between the core portion 25 and the cover portion 21 and because the small convex portion of the core portion 25 functions as a wedge for the cover portion 21. These results also show that when the value of the diameter ratio W1/W2 is large (for example, 0.6 or larger), the occurrence of a front gap TG can be more satisfactorily suppressed. This may be because the larger the value of the diameter ratio W1/W2, the larger the volume of the core portion 25 on the front side of the center electrode 20, and the higher the heat transfer performance of the center electrode 20.

In a sample having a value of the diameter ratio W1/W2 of 0.5 (sample No. 22) among samples with the front end shape of type 5, the occurrence of a front gap TG was not found after 1,000 cycles. Although the occurrence of a small front gap TG was found after 1,500 cycles, the formed front gap TG was still small even after 2,000 cycles. In a sample having a value of the diameter ratio W1/W2 of 0.7 (sample No. 23) among the samples with the front end shape of type 5, the occurrence of a front gap TG was not found after 1,500 cycles, and a front gap TG formed was still small even after 2,000 cycles. These results show that when a concave portion and a convex portion are formed at the front end of the core portion 25 and a diameter reduction portion SR is also formed, the occurrence of a front gap TG can be suppressed. This may be because of the following reasons. The concave-convex shape of the front end portion of the core portion 25 provides the effect of increasing the area of contact between the core portion 25 and the cover portion 21. In addition, the diameter reduction portion SR of the core portion 25 functions to prevent the cover portion 21 from coming off and increases the area of contact between the cover portion 21 and the core portion 25. These results also show that when the value of the diameter ratio W1/W2 is large (for example, 0.7 or larger), the occurrence of a front gap TG can be more satisfactorily suppressed. This may be because the larger the value of the diameter ratio W1/W2, the larger the volume of the core portion 25 on the front side of the center electrode 20, and the higher the heat transfer performance of the center electrode 20.

In a sample with the front end shape of type 6 (sample No. 24), the occurrence of a front gap TG was not found even after 2,000 cycles. This result shows that the occurrence of a front gap TG can be very satisfactorily suppressed when a concave portion and a convex portion are formed at the front end of the core portion 25, at least part of the convex portion is a small convex portion, a diameter reduction portion SR is formed, and the center electrode 20 has a cross section perpendicular to the axis OL (a radial cross section) in which the core portion 25, the cover portion 21, the core portion 25, the cover portion 21, and the core portion 25 are arranged in that order on at least one straight line passing through the center CG of the cross section. This may be because of the following reasons. When the core portion 25 has the above-described shape, the area of contact between the cover portion 21 and the core portion 25 is further increased, and the wedge effect due to the small convex portion and the effect of preventing coming-off due to the diameter reduction portion SR are achieved over a relatively wide region on the radial cross section.

B. Modified Embodiments

The present invention is not limited to the above embodiments and modes and may be embodied in various other forms without departing from the scope of the invention. For example, the following modifications are possible.

The structures of the spark plug 100 and the center electrode 20 serving as a component thereof in the above embodiment are only examples and can be modified variously. For example, in the above embodiment, the center electrode 20 has a two-layer structure composed of the cover portion 21 and the core portion 25. However, for example, the center electrode 20 may include a double-layered core portion 25 (in this structure, for example, an inner portion formed of a nickel alloy is covered with an outer portion formed of copper) and have a structure including a total of three layers. Alternatively, the center electrode 20 may have a structure including four or more layers. The materials of the layers in the center electrode 20 are not limited to the materials described in the above embodiment. Of course, the structure and material of the work W used as the starting member for producing the center electrode 20 are not limited to the structure and material described in the above embodiment.

The effects of the present invention are achieved when the diameter R1 of the radial cross section of the center electrode 20 at the front end position of the core portion 25 is larger than 2.1 mm (i.e., the radial cross-sectional area of the center electrode 20 at this position is larger than 3.5 $mm^2$). When the diameter R1 is 2.1 mm or less (the cross-sectional area is 3.5 $mm^2$ or less) as in the above embodiment, a front gap TG is more likely to occur during thermal cycles. Therefore, the application of the present invention can provide a higher effect of suppressing the occurrence of a front gap TG.

The effects of the present invention can be achieved even when the value of the diameter ratio W1/W2 is less than 0.6. However, by setting the value of the diameter ratio W1/W2 to be 0.6 or larger, higher effects can be achieved, as in the above embodiment.

In the example shown in FIG. 4, the center electrode 20 has, as a cross section perpendicular to the axis OL (a radial cross section), a cross section in which the core portion 25, the cover portion 21, the core portion 25, the cover portion 21, and the core portion 25 are arranged in this order on any line passing through the center CG of the cross section (the cross section in FIG. 4(*b*)). However, the center electrode 20 may have, as a cross section perpendicular to the axis OL, a cross section in which the core portion 25, the cover portion 21, the core portion 25, the cover portion 21, and the core portion 25 are arranged in this order on at least one line passing through the center CG of the cross section. FIG. 16 is set of explanatory views illustrating the specific structures of center electrodes 20 of modified embodiments. FIGS. 16(*a*) and 16(*b*) show the cross sectional structures of the center electrodes 20 corresponding to FIG. 4(*b*). In the center electrode 20'''' of the modified embodiment shown in FIG. 16(*a*), the edge convex portion CPe is not continuous over 360° about the axis OL and has a partially cut shape. However, the core portion 25'''', the cover portion 21'''', the core portion 25'''', the cover portion 21'''', and the core portion 25'''' are arranged in this order on, for example, a vertical line passing through the center CG in the figure. In the center electrode 20'''' of the modified embodiment shown in FIG. 16(*b*), the edge convex portion CPe is not continuous over 360° about the axis OL and is divided into two sections. However, the core portion 25'''', the cover portion 21'''', the core portion 25'''', the cover portion 21'''', and the core portion 25'''' are arranged in this order on, for example, a vertical line passing through the center CG in the figure. Even in the center electrodes 20 of the modified embodiment shown in FIG. 16, the area of contact between the cover portion 21 and the core portion 25 is further increased, and the wedge effect due to the small convex portion and the effect of preventing coming-off due to the diameter reduction portion SR are achieved over a relatively wide region on the radial cross section, so that the occurrence of a front gap TG can be satisfactorily suppressed.

In the above embodiment, when the center electrode 20 is produced, the work W is subjected to extrusion molding twice, and then the support portion 27 is formed. However, the number of extrusion molding processes performed before the formation of the support portion 27 may be one or three or more. In the above embodiment, the molded products M1 and M2 are cut to remove prescribed regions. However, the prescribed regions may be removed by another removing means such as polishing instead of cutting. In the above embodiment, burr treatment is performed after the cutting treatment for the secondary molded product M2. However, burr treatment may be performed also after cutting treatment for the primary molded product M1. The burr treatment may not be performed.

In the description of the above embodiment, the present invention is applied to the center electrode 20. However, the present invention is applicable to the ground electrode 30. FIGS. 17 and 18 are explanatory views illustrating the structure of a ground electrode 30 of a modified embodiment. FIG. 17 shows the side view and cross-sectional view of the ground electrode 30' near the distal end portion 38, as viewed from the side toward the center electrode 20, and FIG. 18 shows the view of a cross section perpendicular to a ground electrode axis SL at position C-C in FIG. 17. As shown in FIGS. 17 and 18, the ground electrode 30' includes a cover portion 321 and a core portion 325 covered with the cover portion 321. The core portion 325 is formed of a material having a thermal expansion coefficient different from that of the cover portion 321. Let a side close to the discharge gap DG be the front side of the ground electrode 30'. Then a central convex portion CPm, an edge convex portion CPe, and a front end concave portion DPt interposed therebetween are formed at the front end of the core portion 325 of the ground electrode 30', and a diameter reduction portion SR is also formed. In the ground electrode 30' described above, the occurrence of a front gap TG between the cover portion 321 and the core portion 325 can be suppressed, as in the case of the center electrode 20 of the above embodiment.

Among the components of the invention in the above embodiments, components other than components described in an independent claim are optional components and can be appropriately omitted or combined.

DESCRIPTION OF REFERENCE NUMERALS

3: ceramic resistor
4: seal body
5: gasket
10: ceramic insulator
12: axial bore
13: leg portion
17: front trunk portion
18: rear trunk portion
19: central trunk portion
20: center electrode

21: cover portion
25: core portion
27: support portion
28: cover material
29: core material
30: ground electrode
37: base end portion
38: front end portion
40: metal terminal
50: metallic shell
51: tool engagement portion
52: screw portion
54: seal portion
57: front end surface
100: spark plug
321: cover portion
325: core portion
W: work
M1: primary molded product
M2: secondary molded product
DG: discharge gap
SR: diameter reduction portion
CPe: edge convex portion
CPm: central convex portion
DPt: front end concave portion

What is claimed is:

1. A spark plug comprising a center electrode and a ground electrode which forms a gap between the ground electrode and the center electrode, wherein, when a side toward the gap is taken as a front side of the center electrode or the ground electrode, at least one of the center electrode and the ground electrode has a cover portion and a core portion covered with the cover portion and formed of a material having a thermal expansion coefficient different from a thermal expansion coefficient of the cover portion, the core portion of the at least one electrode has a concave portion and a convex portion formed at the front side of the core portion, and the convex portion is such that, in a cross section passing through a center axis of the electrode and also passing through the convex portion with a line along the cross section perpendicular to a bisector of the convex portion and passing through a point 0.2 mm shifted from a front end of the convex portion in a direction of the bisector, the line intersecting a contour of the convex portion at two points, a cross-sectional area of the cross section passing through the convex portion delimited by the contour of the convex portion and the line perpendicular to the bisector is smaller than a triangular area of the cross section having vertices at the front end of the convex portion and each of the two points of intersection of the line perpendicular to the bisector and the contour of the convex portion.

2. The spark plug according to claim 1, wherein a ratio of a diameter of the core portion at a position 1 mm shifted from a position of a front end of the core portion in a direction perpendicular to a radial direction to a diameter of the core portion at a position 5 mm shifted from the position of the front end of the core portion in the direction perpendicular to the radial direction is 0.6 or larger.

3. The spark plug according to claim 1, wherein a radial cross section of the at least one electrode at a front end of the core portion has an area of 3.5 $mm^2$ or smaller.

4. The spark plug according to claim 1, wherein the core portion has a diameter reduction portion formed such that a diameter thereof decreases toward a rear end of the core portion.

5. The spark plug according to claim 1, wherein at least one of the center electrode and the ground electrode has, as a radial cross section, a cross section in which the core portion, the cover portion, the core portion, the cover portion, and the core portion are arranged in this order on at least one straight line passing through a center of the cross section.

6. The spark plug according claim 5, wherein at least one of the center electrode and the ground electrode has, as a radial cross section, a cross section in which the core portion, the cover portion, the core portion, the cover portion, and the core portion are arranged in this order on any straight line passing through the center of the cross section.

7. A spark plug comprising a center electrode and a ground electrode which forms a gap between the ground electrode and the center electrode, wherein, when a side toward the gap is taken as a front side of the center electrode or the ground electrode, at least one of the center electrode and the ground electrode has a cover portion and a core portion covered with the cover portion and formed of a material having a thermal expansion coefficient different from a thermal expansion coefficient of the cover portion, the core portion of the at least one electrode has a concave portion formed at the front side of the core portion, and the core portion has a diameter reduction portion formed such that a diameter thereof decreases toward a rear end of the core portion.

8. The spark plug according to claim 7, wherein a ratio of a diameter of the core portion at a position 1 mm shifted from a position of a front end of the core portion in a direction perpendicular to a radial direction to a diameter of the core portion at a position 5 mm shifted from the position of the front end of the core portion in the direction perpendicular to the radial direction is 0.6 or larger.

9. The spark plug according to claim 7, wherein a radial cross section of the electrode at a front end of the core portion has an area of 3.5 $mm^2$ or smaller.

10. The spark plug according to claim 7, wherein at least one of the center electrode and the ground electrode has, as a radial cross section, a cross section in which the core portion, the cover portion, the core portion, the cover portion, and the core portion are arranged in this order on at least one straight line passing through a center of the cross section.

11. The spark plug according claim 10, wherein at least one of the center electrode and the ground electrode has, as a radial cross section, a cross section in which the core portion, the cover portion, the core portion, the cover portion, and the core portion are arranged in this order on any straight line passing through the center of the cross section.

* * * * *